US005931003A

United States Patent [19]

Newman et al.

[11] Patent Number: 5,931,003

[45] Date of Patent: Aug. 3, 1999

[54] METHOD AND SYSTEM FOR ELECTRONICALLY CONTROLLING THE LOCATION OF THE FORMATION OF ICE WITHIN A CLOSED LOOP WATER CIRCULATING UNIT

[75] Inventors: Todd R. Newman, Reed City; David Shank, Big Rapids; Robert E. Taylor, Cadillac, all of Mich.

[73] Assignee: Natron Corporation, Reed, Mich.

[21] Appl. No.: 08/906,015

[22] Filed: Aug. 4, 1997

Related U.S. Application Data

[63] Continuation-in-part of application No. 08/522,848, Sep. 1, 1995, Pat. No. 5,653,114.

[51] Int. Cl.[6] ..... F25C 1/12

[52] U.S. Cl. ..... 62/74; 62/135

[58] Field of Search ..... 62/73, 74, 135, 62/138, 347

[56] References Cited

U.S. PATENT DOCUMENTS

| | | |
|---|---|---|
| 3,908,390 | 9/1975 | Dickson et al. . |
| 4,137,724 | 2/1979 | Alexander . |
| 4,318,278 | 3/1982 | Olson et al. . |
| 4,357,808 | 11/1982 | Olson et al. . |
| 4,452,049 | 6/1984 | Nelson . |
| 4,471,624 | 9/1984 | Nelson . |
| 4,510,114 | 4/1985 | Nelson . |
| 4,671,077 | 6/1987 | Paradis . |
| 4,938,030 | 7/1990 | Josten et al. . |
| 4,959,966 | 10/1990 | Dimijian . |
| 5,291,747 | 3/1994 | Sakai et al. . |

OTHER PUBLICATIONS

Copyright© 1994, The Physical States of Water, *1995 Compton's NewMedia, Inc. Encyclopedia* (All Rights Reserved. No Credit (2 pages of a partial article).

Standard Grant Notification for Investigation Into the Use of Supercooled Water for Ice–Jet Machining, (3 pages).

Partial article discussing "rime ice" from Jan. 1995, *Sensors Magazine* (p. No. 22).

*Primary Examiner*—William E. Tapoicai

*Attorney, Agent, or Firm*—Brooke & Kushman P.C.

[57] ABSTRACT

A method and system for electronically controlling the location of the formation of ice within a closed loop water circulating unit and efficiently harvesting ice includes a method and system for making ice using supercooled water. When a desired degree of supercooling is reached in the closed loop water circulating unit, a pump associated with the ice-making machine is stopped so as to initiate ice seeding on the ice mold. After the pump is restarted, the supercooled water flows over the seeded molds to rapidly form ice on the ice molds. The completion of ice formation in the mold is sensed by reservoir water temperature, water level, timing or other inputs to enable a controller to automatically control a harvest cycle timely. A method and system is also provided for improving the clarity of the ice. Furthermore, in an ice-making machine having two or more ice molds, a method and system is provided for allowing one mold to act as a condenser in a harvest mode, while simultaneously allowing the remaining molds to act as evaporators in the freezing mode. The ice-making method and apparatus decreases the cycle time for forming ice.

6 Claims, 7 Drawing Sheets

METHOD AND SYSTEM FOR ELECTRONICALLY CONTROLLING THE LOCATION OF THE FORMATION OF ICE WITHIN A CLOSED LOOP WATER CIRCULATING UNIT

CROSS REFERENCE TO RELATED APPLICATION

This application is a continuation-in-part of application Ser. No. 08/522,848, filed Sep. 1, 1995, now U.S. Pat. No. 5,653,114.

TECHNICAL FIELD

This invention relates to ice-making machines, and more particularly, to methods and systems for electronically controlling the location of the formation of ice within a closed loop water circulating unit.

BACKGROUND ART

In conventional home freezer systems, an ice-making machine includes at least one ice mold. However, more sophisticated systems may include a series of ice molds. In order to make ice, the ice mold is first filled with cold tap water. The water and ice mold are then cooled by heat conduction through a surface which the ice mold is placed upon. The water and ice mold are also cooled by convection through the air located above the water and the ice mold. As heat is extracted, the water is slowly converted to ice. However, this method for forming ice cubes can take an hour or more.

The above described process is too slow to provide an adequate supply of ice cubes in a restaurant or vending machine application without the use of a large freezer and several ice molds. To circumvent this problem, commercial ice makers use ice molds that are cooled directly through circulating refrigerant. Consequently, cooling capacity is delivered directly and rapidly to the ice molds. Commercial ice makers are also designed to automatically fill the ice molds with water when they are empty and to automatically empty the ice molds when they are filled with ice.

The challenges associated with automatic ice-making are several and include the following: preventing freezing in pumps and plumbing when supercooled water is circulated, achieving uniform and rapid filling of all the ice molds, achieving complete and uniform freezing in all the ice molds, achieving complete release of the ice cubes from the ice molds when freezing is complete, minimizing freezing time and energy consumption, and achieving a high yield. It is also desirable in some cases to produce ice cubes with a high degree of clarity.

In addition, ambient light, heat, and wind can have detrimental effects such as a reduced rate of ice production, although an extended period of production may provide the side benefit of producing ice of better clarity. The ambient conditions may also reduce efficiency due to undesired heat transfer causing differing rates of ice production from mold to mold, and causing differing rates of ice production from one individual mold cavity to another cavity of the same mold. Existing systems operating on fixed timers for harvesting of ice suffer substantial limitations. A number of conditions such as high ambient temperature, low refrigerant gas, dirty cooling fins, obstructed cooling fins, and the like performance and efficiency of each component can typically result in inadequate freezing of the ice such that the ice is small and has hollow areas and is very watery. The design, matching, and application of ice machine components including compressor, evaporator, and fans can be less than optimal especially in widely diverse ambient operating conditions.

When liquid water is cooled to 32° F., the water can begin to freeze. The freezing of the water will take place as the heat of fusion (79.7 cal/gram) is removed. During freezing a water-ice mixture is present, and the water and ice remains at a temperature of 32° F. until freezing is complete, assuming there is adequate thermal contact between the water and ice. Once freezing is completed, the temperature of the ice will drop as more heat is extracted. Freezing will also begin if an ice piece or other suitable "seed" crystal is present in sub-freezing (<32° F.) water. A seed crystal initiates ice growth starting at the surface of the seed and progressing outward. Freezing can also be initiated in sub-freezing water if the water is subjected to a sudden vibration. At low enough temperatures, a tap on the side of the container holding the sub-freezing liquid can be sufficient to initiate freezing.

Absent a seed crystal or vibration, it is possible to cool water to a temperature below 32° F. Once water is cooled below its freezing point, i.e., 32° F., it is considered to be supercooled. Supercooled water will rapidly begin to freeze when exposed to a "seed" crystal, sharp vibration or small vibrations at extremely low temperatures. Due to the 79.7 cal/gram heat of fusion, it is possible for a given mass of supercooled water to have more heat content than the same mass of ice at 32° F. For instance, the heat content of 10 grams of 8° F. liquid water is 2166 cal while the heat content of 10 grams of 32° F. ice is 1502 cal. There is considerably more heat (44% more) in the liquid water than in the ice. Yet, the water is at a lower temperature than the ice. In order for the 8° F. water to freeze entirely, its extra 664 cal (2,166–1,502) of heat content would have to be rejected.

If approximately 16.7% of the 8° F. water were converted to ice at 32° F. and approximately 83.3% was to remain in a liquid state at 32° F., the heat content would be 2166 cal which is the same heat content as the original 8° F. water. This is essentially what happens once freezing is initiated in supercooled water. A volume of a gallon or more of supercooled water at a sub-freezing temperature will convert to a slush (small ice particles+water) in a matter of seconds once freezing has been initiated. When the supercooling is eliminated through freezing, the freezing stops and the temperature equilibrates at 32° F. with no degree of supercooling. The ratio of ice to liquid is dependent on the degree of supercooling in the liquid water before the formation of ice has occurred.

FIG. 1 illustrates the fraction of liquid water in a slush mixture, following its formation from supercooled water, as a function of the initial temperature of the supercooled water. As can be seen, 27° F. water can be expected to form a slush mixture of 97% liquid water and 3% ice. Similarly, −20° F. water will form a slush mixture of 64% liquid water and 36% ice. Also, note that −111° F. water will form solid ice.

An automatic ice-making system typically has some degree of plumbing associated therewith to properly route the water. Some systems may also include pumps and automatic valves as well. In these systems, there is no problem associated with supercooled water as long as it is completely liquid. However, when and if the supercooled water converts to a slush, the small ice particles in the slush can cause clogging in the plumbing, the pump and/or the valves as well as cause ice accumulation in undesired locations. To overcome these problems, some known systems prevent or minimize supercooling at undesired locations by adding tap water to the overall system or by utilizing heaters. This results in system inefficiencies as more water is cooled or water is both cooled and heated. Ideally, a system will utilize most of its cooling capacity in forming ice. In systems that have supercooling, efficiency will be maximized by converting the supercooled water to ice without adding heat to it first.

The known prior art includes U.S. Pat. No. 4,671,077, issued to Paradis, which describes a system in which water is deliberately supercooled to increase the capacity of a heat exchanger. Water having a temperature of 32° F. or warmer enters the heat exchanger and exits as supercooled water. The supercooled water is then deliberately used to make slush in a reservoir rather than on the surface of the heat exchanger itself. Part of the supercooled liquid water flowing from the heat exchanger is transformed to ice upon contact with the water in the reservoir and is used for space cooling. Alternatively, the ice obtained by this process may be filtered for various other applications, such as soft ice for packaging and preserving fish, for the preservation of certain vegetables, and for making slush drinks.

Conventional collection bin accumulation level systems are prone to interference from ambient light coming through partially translucent plastic panels and from the ice bin when the door is opened. In addition, ambient light can reflect and refract from the ice within the ice bin and through the panels to give false signals of falling ice and of bin full.

Another problem associated with ice-making systems is the lack of clarity in the ice cubes. Two contributing factors in the lack of ice clarity include the entrapment of small air bubbles as liquid water converts to ice and flaws from internal stresses and strains associated with rapid ice formation and/or induced by ice expansion against the mold cavity.

The solubility of air in liquid water is greater at lower temperatures than at elevated temperatures. For instance, the solubility of air in water is substantially greater at lower temperatures above 32° F. than at high temperatures of water. AT 0° C. the solubility of air in water is 87% higher than at 30° C. At 0° C. the solubility of carbon dioxide in water is 166% higher than at 30° C. Any air or gasses dissolved in the water above the concentration that can be contained by the solubility of air or gases in ice attempts to reach solubility equilibrium by coming out of solution when the liquid water freezes into solid water. In slow cooling processes excess dissolved air has time to be released by the water as it slowly freezes. This is not necessarily the case in a more rapid freezing process as is found in automatic ice-making machines equipped with directly cooled ice molds. Similarly, in cases of rapid ice formation, internal strains can be associated with the forming of ice as it expands due to freezing, especially if it is unable to expand against the ice mold.

Clarity of the ice can be improved by driving off trapped air before the water reaches the ice molds. However, heating the water with a heater or using hot tap water when the system is filled to eliminate trapped air has the disadvantage of adding energy to the system, and thereby lowers overall system efficiency.

A further problem associated with ice-making systems is the difficulty associated with achieving uniform and rapid filling of the ice mold and freezing in the ice mold. The use of a fine spray of water onto a chilled ice mold has been contemplated as can be seen, for example, in U.S. Pat. No. 4,510,144, issued to Nelson, and U.S. Pat. No. 3,908,390, issued to Dickson et al. However, excess or make-up water is abundant resulting in an inefficient system due to a loss in cooling capacity as the excess water is recirculated.

DISCLOSURE OF THE INVENTION

It is thus a general object of the present invention to provide a new and improved method and system for making ice in an ice-making machine.

It is a more particular object of the present invention to provide a method and system for electronically controlling the location of the formation of ice within a closed loop water circulating unit of an ice-making machine.

It is still a particular object of the present invention to provide a method and system for optimizing the degree of supercooling so as to eliminate the formation of slush in the plumbing of an ice-making machine.

It is another object of the present invention to provide a method and system for increasing the efficiency of a condenser associated with an ice-making machine having one or more ice molds by temporarily using one ice mold as a condenser while simultaneously having one or more ice molds act as an evaporator.

It is yet another object of the present invention to provide a method and system for improving the clarity of manufactured ice without affecting the efficiency of the system.

Still further, it is an object of the present invention to provide a method and system for controlling the formation of manufactured ice using a fine spray in conjunction with a chilled ice mold with little or no excess water to recirculate.

Improvements to efficiency and consistency of ice production can be effected by incorporation of thermal insulation and heat reflective shielding to block undesired light and/or thermal radiation and also by blocking undesired air flow paths such that the design of forced and/or natural air convection will maintain precise temperature profiles for consistent ice formation and precise temperature sensing despite ambient light, heat, and wind.

In carrying out the above objects and other objects, features and advantages, of the present invention, a method is provided for electronically controlling the location of the formation of ice within a closed loop water circulating unit of an ice-making machine. This new system utilizes adaptive control algorithms based on various inputs from known and novel ice making cycles that produces consistent sized pieces of ice whether at full or at reduced production capability under adverse conditions which might otherwise cause conventional timer-based controllers to be inoperable or produce small and inconsistent ice pieces. The disclosed system can adaptively operate with small ice making systems, for example, less than smaller than 50 pounds per day, as well as large systems, for example, larger than 2000 pounds per day, giving each the capability of producing consistent size and shape of ice pieces regardless of misdesign, misapplication, partial malfunction, production rate, water supply temperature, and ambient conditions of temperature and wind.

The preferred method includes the steps of generating a first signal and providing water to the ice-making apparatus upon receipt of the first signal. The method also includes the step of generating a second signal and prohibiting the water from being provided to the ice-making apparatus upon receipt of the second signal. In addition, the method includes the step of starting the flow of water through the closed-loop water circulating unit to an icing site upon receipt of the second signal. The method further includes the step of cooling the water at the icing site as it flows through the water circulating unit of the ice-making machine. Furthermore, the method includes the steps of sensing a temperature of the water as it circulates through the water circulating unit and comparing the sensed temperature to a first predetermined temperature threshold. If the sensed temperature is below the first predetermined temperature threshold, a third signal is generated. The method further includes the step of stopping the flow of water through the closed-loop water circulating unit upon receipt of the third signal. After a first predetermined detection, a fourth signal is generated. Still further, the method includes the step of restarting the flow of water to the icing site upon receipt of the fourth signal.

In further carrying out the above objects and other objects, features and advantages, of the present invention, a system is also provided for carrying out the steps of the above described method. The system includes a sensor for sensing the temperature of the water as it flows through the closed-loop water circulating unit. The system also includes a controller for generating the first, second, third and fourth signals.

Still further, in carrying out the above objects and other objects, features and advantages, of the present invention, an apparatus is provided for carrying out the steps of the above-described method. The apparatus includes a closed loop water circulating unit including a water inlet fluidly coupled to a water supply, a water manifold in fluid communication with the water inlet, and an ice mold adapted to receive a flow of refrigerant. The closed loop water circulating unit also includes a reservoir for collecting excess water and a pump for transferring the water from the reservoir to the water manifold. The excess water results from undesired melting of ice from the molds, usually caused by circulating water that is at a temperature above freezing or caused by extraneous heat leakage such as from external ambient conditions. The apparatus further includes a valve for controlling the flow of water from the water supply to the closed loop water circulating unit and sensors for sensing the temperature and the level of water in the closed loop water circulating unit.

The water supply for this ice making system can be integral within the machine or as a separate module which can incorporate a number of functional features for improvement of the quality of the water used for a single ice machine or for a plurality of ice making machines. In some applications it is found necessary to occasionally purge the water in the ice making system with new water due to the accumulation of particulate matter. For these cases it may be beneficial to have a water turbidity sensor which can signal the control circuit when it is necessary to provide a cleansing purge cycle with fresh water from the supply.

Finally, the apparatus includes a controller for generating a first, second, third, and fourth signal. The first signal initiates the transfer of water from the water supply to the water inlet. The second signal stops the flow of water from the water supply when the ice-making apparatus is charged with water and starts the pump to circulate the water through the apparatus. The third signal stops the flow of water by turning off the pump if the sensed temperature falls below a first predetermined temperature threshold. The fourth signal generated by the controller restarts the flow of water by turning on the pump.

Still further, in carrying out the above objects and other objects, features and advantages, of the present invention, a method is provided for making ice while generating little or no excess water. The method includes the step of cooling an ice mold to obtain a chilled ice mold. The method also includes the step of supercooling the water to be applied to the chilled ice mold to obtain supercooled water. The method also includes the step of spraying the super-cooled water onto the chilled ice mold, thereby reducing the amount of excess water.

In carrying out the above objects and other objects, a system is also provided for carrying out the steps of the above-described method. The system includes means for cooling an ice mold to obtain a chilled mold. The system also includes means for supercooling the water to be applied to the chilled ice mold. The system also includes a sprayer for spraying the super-cooled water onto the chilled ice mold so as to reduce the amount of excess water. This system also offers accumulation and storage improvements in sensing of falling ice and ice bin full via optoelectronic infrared emitter and pairs coupled to sense beam blockage.

The above objects, as well as other objects, features and advantages of the present invention are readily apparent from the following detailed description of the preferred embodiments for carrying out the invention when taken in connection with the accompanying drawings.

PREFERRED EMBODIMENTS FOR CARRYING OUT THE INVENTION

Figure 2:
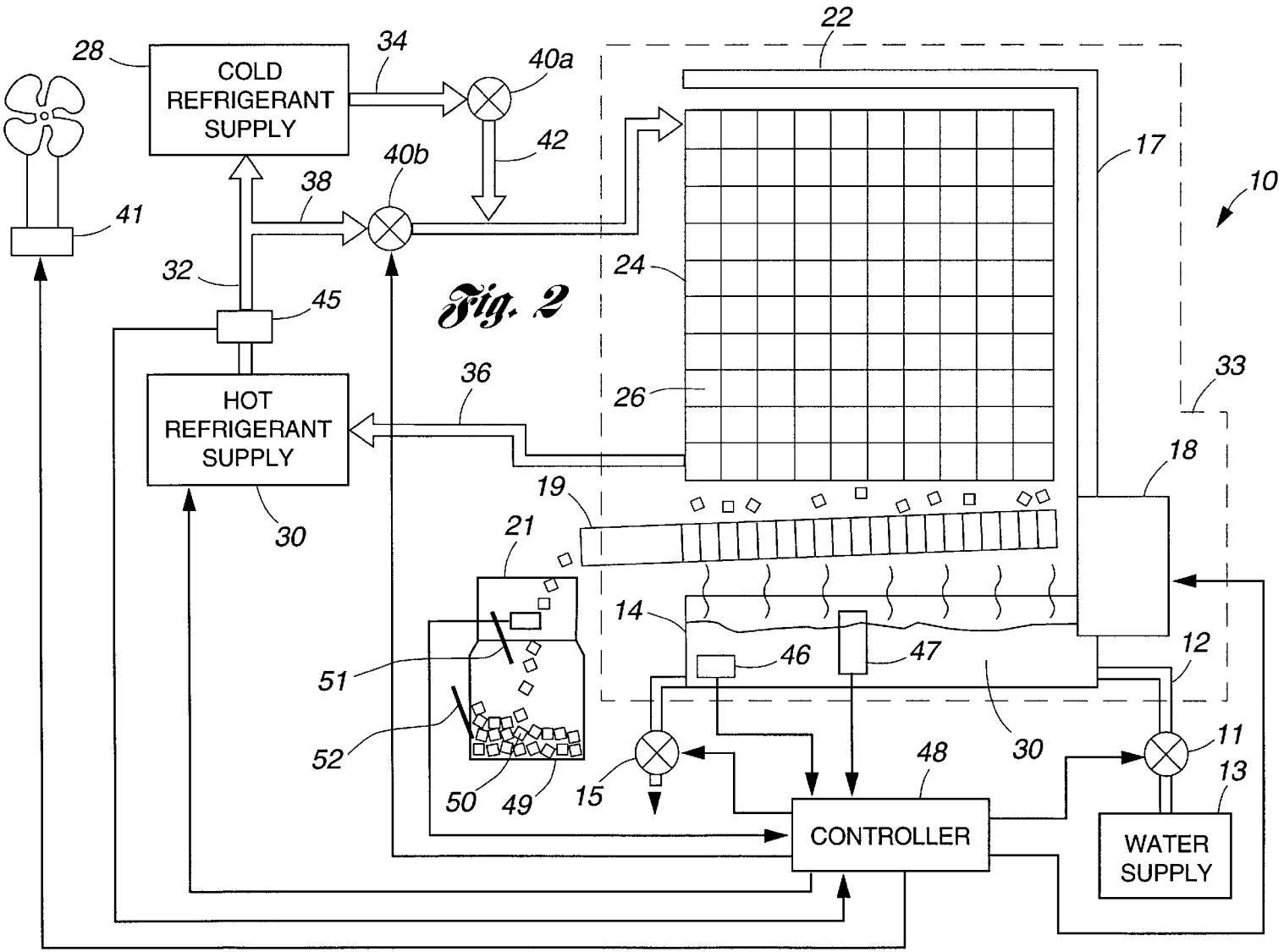
FIG. 2 is a schematic diagram of the preferred embodiment of the system of the present invention.

Turning now to FIG. 2, there is shown a schematic diagram of the ice-making system of the preferred embodiment of the present invention, denoted generally by reference numeral 10. The system 10 includes a water inlet line 12 for receiving water from a water supply 13. A valve 11 is provided in fluid communication between the water inlet line 12 and the water supply 13. The valve 11 controls the flow of water from the water supply 13 to the water inlet line 12. Valve 15 is provided for occasional purging of the reservoir 14 by draining the water 16 to avoid excessive accumulation of insoluble water contaminants, for the purpose of draining the reservoir of cleaning solutions, and for dry storage.

The water supply 13 may be integral with or separate from the ice making apparatus. As a module of the system, the supply 13 may be provided with numerous features. Precooling of water, particulate filtration for cleaner ice, and control and timing of cleaning cycles may be installed. Activated charcoal and/or carbon filtration can be used for removal of organic contaminants which can produce undesired color, odor, and taste. Antimicrobial treatments can be used such as ultraviolet radiation, ozonation, exposure to silver, aeration, and addition of colloidal silver including manufacturing unit of colloidal silver or a loader of purchased colloidal silver may be used to destroy over 600 microbes without human toxicity. In addition, anti-septics, and antibiotics may be added. The supply may also include pH monitoring and control via open loop control or closed loop feedback controls to introduce suitable acids, bases, and/or buffering compounds.

The supply 13 may include distillation for pure water and ice, including methods whereby energies required for evaporation and condensation are also connected with the energy flow control of the respective cooling and heating operations of the ice making system. The supply 13 may incorporate carbonation via bubbling, spraying and agitation with carbon dioxide. Alternatively, the supply may include degassing for improved ice clarity. Degassing can be achieved by spraying, agitating, high shear, and/or flowing water in the presence in a vacuum chamber. Degassing can also be significantly improved at elevated temperatures such that the heat energy required for heating and cooling can also be connected with the energy flow control of the respective cooling and heating operations of the ice making system for net system energy efficiency by comparison with independently heated and cooled degassing.

The degassed water delivered from a supply 13 is prone to redissolution of air during the ice making process. For demanding clarity requirements, the manufacture of ice can incorporate a vacuum chamber 33 within which the ice molds and reservoir are enclosed to reduce the tendency to dissolve air.

Additional options for incorporation of additives for specific commercial markets for manufacture ice include hard frozen ice from carbonated water that may be improved by maintaining the ice molds and reservoir under pressure with carbon dioxide during the process for use by restaurants, hotels, bars, caterers, home and the like as fizzy ice which will not dilute the carbonation of beverages. In addition, soft frozen ice that has carbon dioxide bubbles, floats higher, lasts longer, and is softer to chew, and can be made from carbonated water which is allowed to degas during freezing. Flavorings, colorings, preservatives, vitamins, minerals, carbohydrates, essential amino acids, phytochemicals, essential fatty acids, sweeteners, and natural antimicrobials may also be added. Isotonic sterile ice for medical open wound applications, sterile ice for those intolerant of microbes typical to many water supplies, or ice containing fresh frozen aloe vera gel so as to maintain its active ingredients can be produced by introducing the pure or medicated water at supply 13. As required, for making ice with fluids having freezing temperatures lower than water, it may be found beneficial to employ additional sensors to determine the fluid specific gravity, electrical conductivity, or freezing temperature which with appropriate control algorithms and alone or in combination, can alter the system to maintain appropriate seeding and subsequent freezing control.

The water inlet line 12 transfers the water 16 to a reservoir 14. When sufficient water is supplied to fill the reservoir 14, as determined by a full/low sensor 47 or two level sensors mounted for detection at different heights, the water inlet line 12 is shut off and a pump 18 pumps the water 16 from the reservoir 14 into a manifold 22. The manifold 22 has holes (not shown) that allow the water 16 to flow down and across an ice mold 24. The flowing water 16 passes across the surfaces of individual ice mold cavities 26 of the ice mold 24.

The system 10 of the present invention also includes a cold refrigerant supply 28 such as a condenser with a heat exchanger and a fan for forced air convection under separate control by the controller 48. The system 10 also has a hot refrigerant supply 30 including a condenser with temperature sensor 45. The cold refrigerant supply 28 includes an inlet line 32 from the hot refrigerant supply 30 and an outlet line 34. The hot refrigerant supply 30 includes an inlet line 36 from the ice mold 24 and the cold refrigerant inlet line 32 to the cold refrigerant supply 28. A hot refrigerant supplemental outlet line 38 is also provided. A first valve **40*a*, typically an automatic thermo-mechanical valve, such as an expansion valve, couples the cold refrigerant supply 28 to the ice mold 24 via a first mold inlet 42. Similarly, a second valve 40*b* couples the hot refrigerant supply 34 to the ice mold 24 via a second mold inlet line 44. The first valve 40*a* and the second valve 40*b*** may be replaced by a single double-acting valve (not shown).

When the system 10 is turned on, cold refrigerant from the cold refrigerant supply 28 is supplied to the ice mold 24 via the first valve **40*a*. The second valve 40*b* is closed. Cold refrigerant vapor or cold mixed phase refrigerant (liquid+vapor) is passed through the cold refrigerant outlet line 34 and the first mold inlet line 42. This allows the ice mold 24 to function as an evaporator. The evaporated refrigerant is then routed back to the hot refrigerant supply 30 through the hot refrigerant inlet line 36**.

The first valve 40a also functions as an expansion device to lower the temperature of the refrigerant before it reaches the ice mold 24. When the first valve **40*a* routes the cold refrigerant through the ice mold 24, the ice mold cavities 26 are rapidly cooled along with the water 16 that flows across the ice mold cavities 26. The cooled water 16 eventually flows back to the reservoir 14 and is eventually circulated back to the manifold 22 through the pump 18. As the water 16 is circulated through the system 10**, heat is steadily removed.

Once ice formation is complete, preferably determined by controller 48 in response to sensors 47, a preset timer, reservoir water temperature or other inputs available, a harvesting sequence commences. Additional inputs to and responses by the controller 48 are useful throughout the ice-making operation, for example, during harvesting as taught in U.S. application Ser. No. 08/829,216 entitled "Methods and Systems For Harvesting Ice In An Ice Making Apparatus", filed Mar. 31, 1997, and incorporated herein by reference in its entirety.

In the preferred embodiment, the condenser fan 41 is turned off to build up heat and temperature of the hot refrigerant gas for a precalculated time duration "A," typically 15 to 60 seconds, as calculated based upon the sense of hot refrigerant temperature by sensor 45 taken during the approximate middle of the freeze cycle. For example in a typical eight minute cycle the temperature of the hot refrigerant gas is sensed at approximately five minutes into the cycle for calculation of time duration "A." At the end of time duration "A" the following occur: The water circulation pump 18 is turned off to reduce undesired melting of the ice, the hot refrigerant valve **40*b* is opened to melt the interface of the ice with each individual mold cavity 26, and the water supply valve 11 is opened until the reservoir 16 is filled with warmer makeup water to increase the temperature of the water 16 in the reservoir 14. After commencement of the above three actions a different precalculated time duration "B," typically 30 seconds, is expended allowing sufficient time for the ice-to-mold interface to melt at which time the water circulation pump 18 is turned on so that the above freezing circulating water will flow over and cause dropping of ice from the individual cavities 26**.

The ice dropping sensors 43, typically infrared optoelectronic beam interrupter types, detect ice pieces after they drop onto the strainer 19 and as they fall down through the ice chute 21 into the ice storage bin 49 and also sense when the ice storage bin 49 is full. The controller calculates times from the last turning on of the water circulation pump 18 to the latest piece of falling ice detected by sensors 43 and calculates the times between successive pieces of falling ice for calculations pertaining to adaptive algorithms for successive ice making cycles. After a final precalculated time duration "C" the hot refrigerant valve 40*b* is closed and the condenser fan 41 is turned on to put the system 10 at the end of the release ice cycle. Adaptive algorithms modify the various harvest time durations based upon timers, sensed temperature sensed falling of ice, and history of previous harvest cycles." When the harvest cycle is complete the water inlet line 12 may be opened to refill the reservoir 14, as required, from the water supply 13 in preparation for another ice making cycle.

The initially ice-free surfaces of the ice mold cavities 26 and the continually moving water 16 in the system 10 combine to allow a supercooling condition to occur in the water. In existing systems, this supercooling of the water 16 can reach a temperature of below 24° F. Slush forms throughout the system when supercooling reaches a system, pressure and water impurity dependent lower limit, for example, 24° F. in the example system. Once the temperature of the water 16 in the reservoir 14 falls below the lower temperature limit, natural vibrations in the system 10 may cause freezing to begin. Typically, this starts at the nozzles in the manifold 22. Once the freezing is initiated, the water 16 may be converted to slush throughout the system 10. The slush obstructs flow such as through the nozzles of the manifold 22 or the pump 18. This slush problem can be circumvented if ice formation can be initiated on the ice mold 24 before an unstable level of supercooling is reached. Once ice formation is initiated on the ice mold 24, the heat of fusion given up by the ice prevents the unfrozen water flowing across the ice mold 24 from retaining any significant degree of supercooling since water in contact with ice tends to maintain an equilibrium temperature of 32° F.

The system 10 of the present invention utilizes a temperature sensor 46 to monitor the temperature of the flowing water. Preferably, the sensor 46 is located in the reservoir 14. An uninsulated reservoir 14 might never reach a supercooled condition since it absorbs heat from ambient air. This would eliminate or minimize supercooling, but would waste cooling capacity. However, an insulated reservoir would waste little cooling capacity, and would be very likely to reach a super-cooled state, thus, requiring the seeding technique of the present invention.

Coupled between the temperature sensor 46 and the pump 18 is a controller 48. When a preferred degree of supercooling has been reached, the controller 48 shuts off the pump 18. The water flowing across the ice mold 24 then runs off the ice mold 24 leaving behind a few droplets. Without the warming action of the flowing water, the ice mold cavities 26, being part of the evaporator, rapidly drop in temperature and thereby create an extreme degree of supercooling in the stationary water droplets left behind. The stationary water droplets then rapidly freeze.

The controller 48 reactivates the pump 18 after a short period of time, such as a few seconds in the stated example. When the pump 18 is turned back on, the flow of water across the ice mold 24 resumes. However, the frozen droplets in contact with the supercooled water form crystal "seeds" upon which the flowing water freezes. Rather than convert to 32° F. slush, the supercooled flowing water converts to 32° F. liquid water as it freezes onto the ice seeds and liberates the "heat of fusion" of the water. The 32° F. water returning to the reservoir 14 rapidly raises the temperature of the water in the reservoir 14 to 32° F.

Seeding can be verified by monitoring the rate at which the temperature of the water in the reservoir 14 rises. If temperature sensor 46 fails to detect a temperature rise to 32° F. in the reservoir 14 after an appropriate time interval, preferably approximately 10 seconds in the example, the controller 48 momentarily shuts off the pump 18 to re-initiate the ice seeding process. This pump stopping and temperature measurement process continues to cycle until a successful ice seeding has been detected. After the ice seeding, the pump 18 is turned on. Upon accomplishing the ice seeding process, the supercooling of the circulating water is removed from the system 10 by ice formation with concurrent liberation of heat of fusion, which takes place only at the desired locations of the individual cavities 26 of the ice mold 24.

Alternatively, it may be desirable to initiate ice seeding with a water temperature above freezing. If seeding is initiated at too high a water temperature, however, the flowing water would melt the ice seed(s) once the pump is re-initiated. Ice seeding can be verified by monitoring the temperature of the reservoir. For example, if ice seeding is initiated at a water temperature of 36° F., the temperature of the water would be expected to slowly drop to 32° F. If the temperature dropped below 32° F., however, this is an indication that seeding has failed.

Figure 3A:
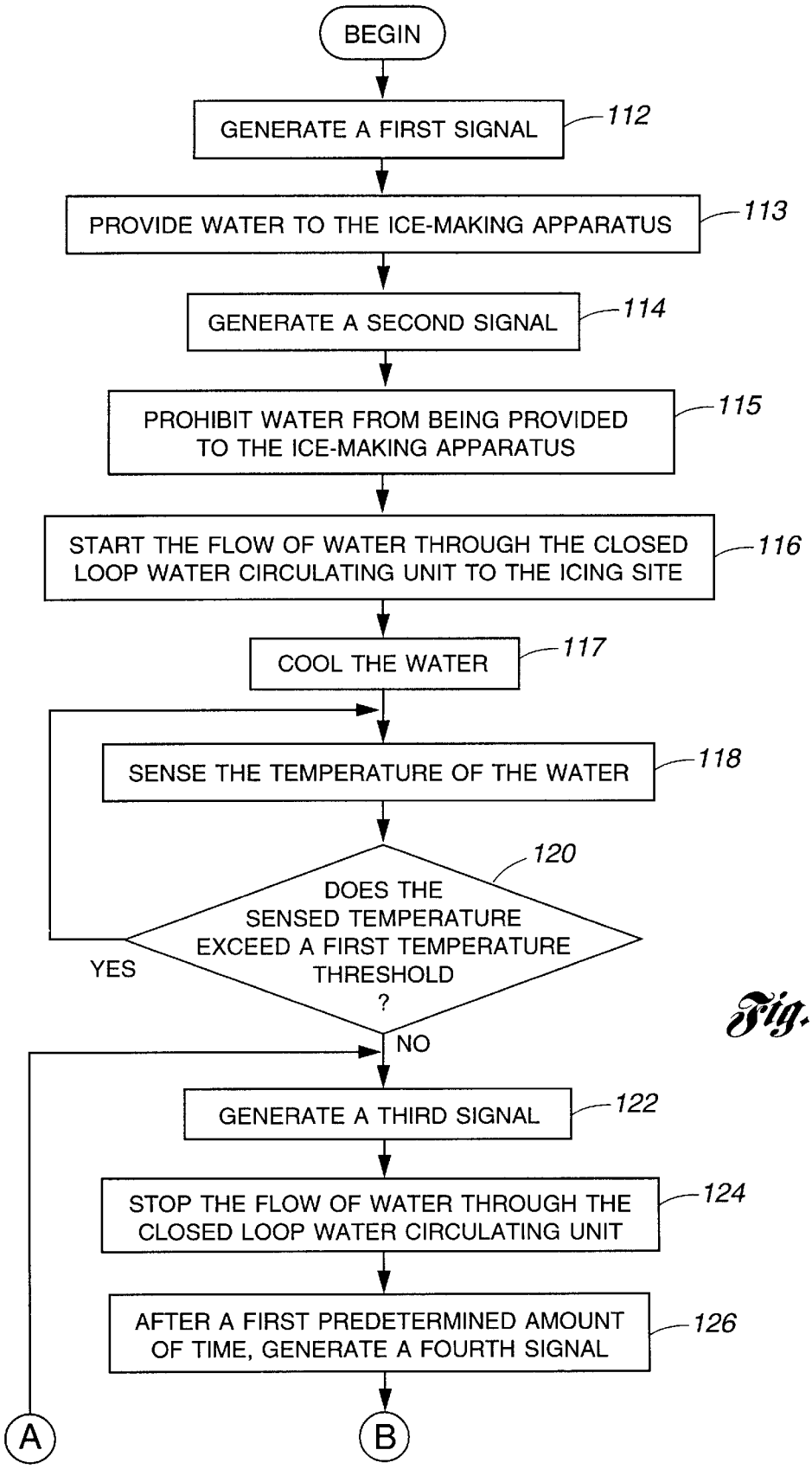
FIGS. 3*a*, 3*b* and 3*c* are flow diagrams illustrating the sequence of steps associated with the method of the preferred embodiment of the present invention.
Figure 3B:
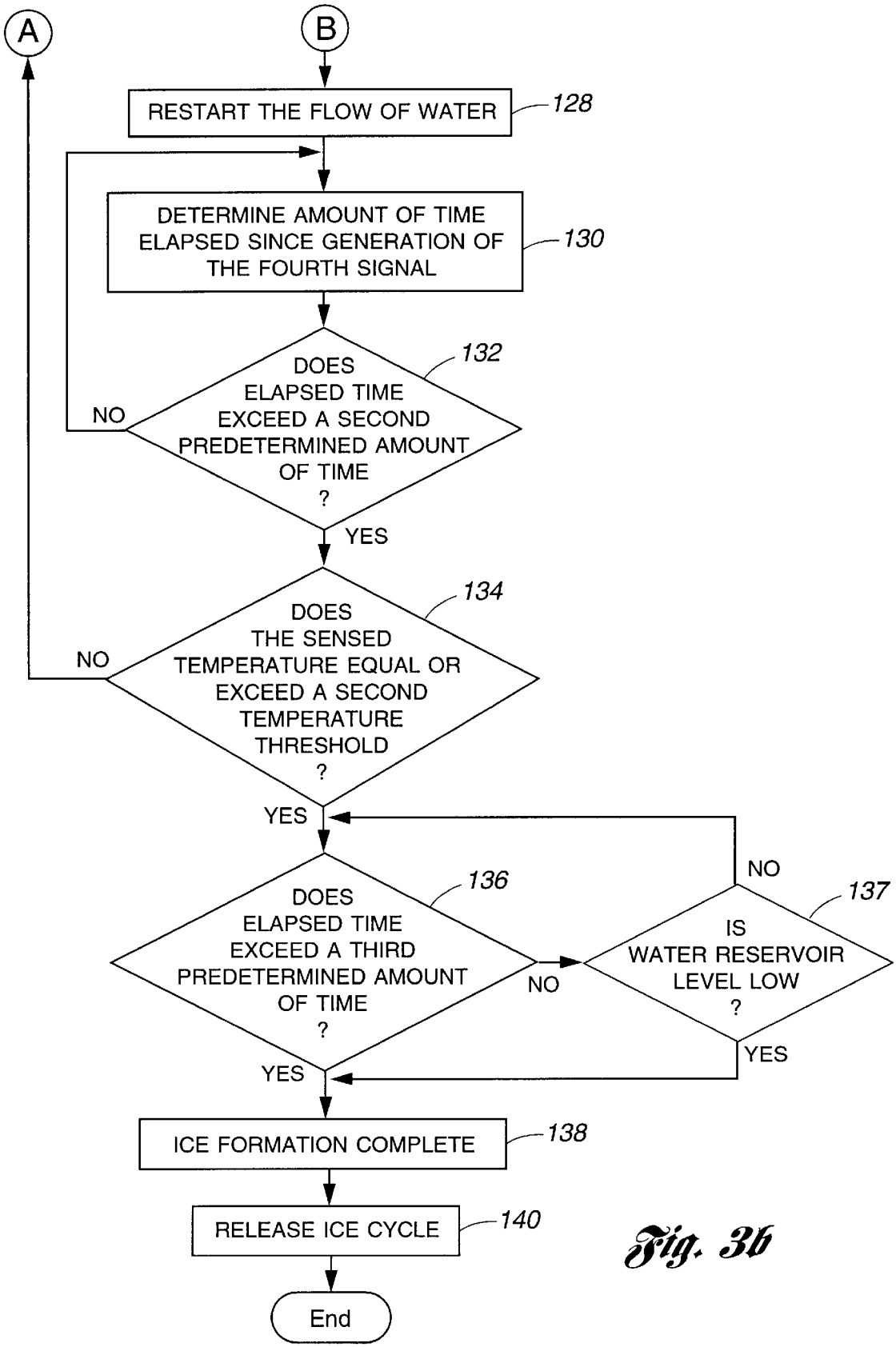
Figure 3C:
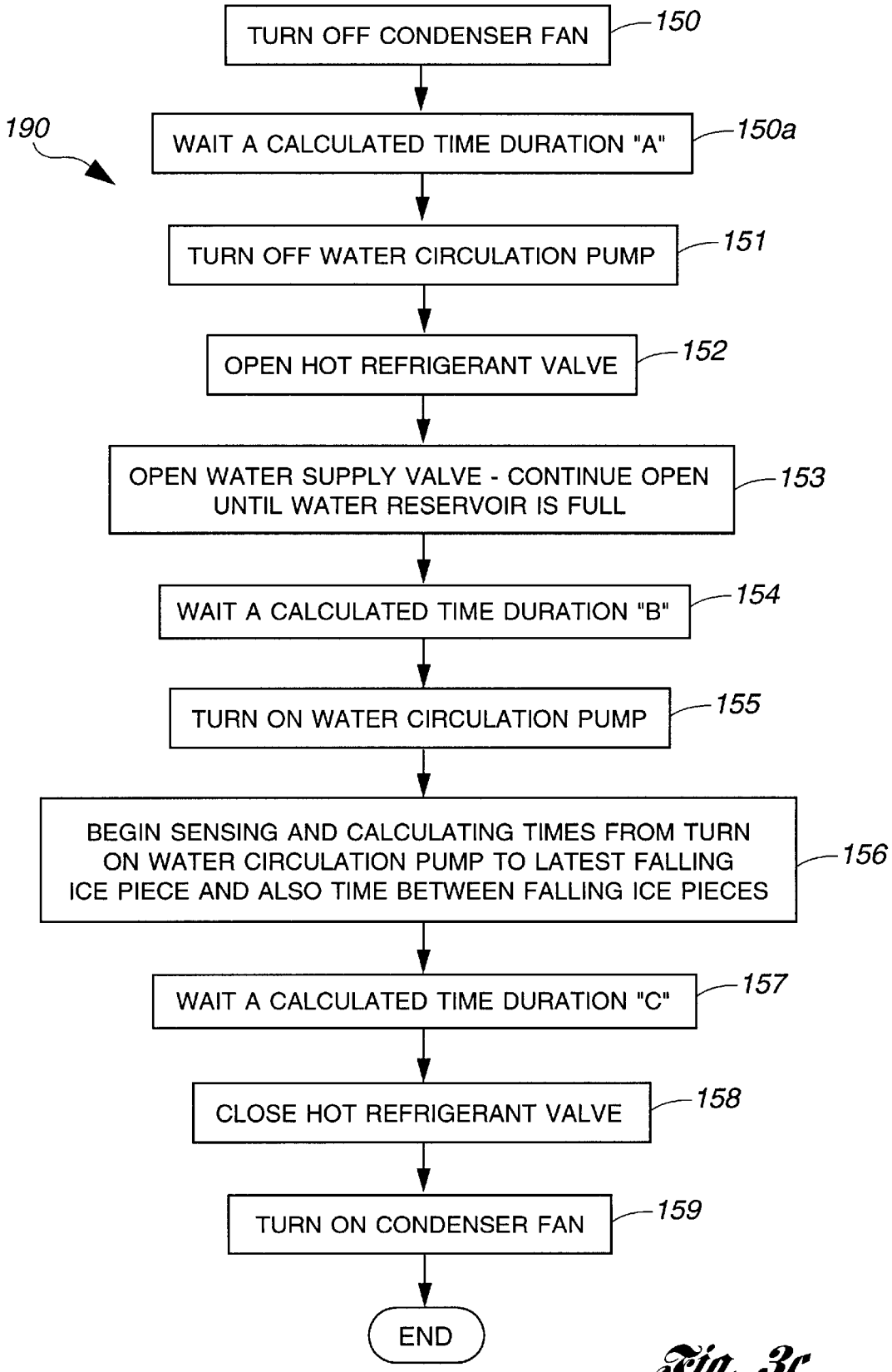

Referring now to FIGS. 3*a*, 3*b* and 3*c*, there is shown a flow diagram illustrating the sequence of steps associated with the preferred embodiment of the present invention. The method begins with the step of generating a first signal, as shown at block 112. Next, method continues with the step of providing water to the ice-making apparatus upon receipt of the first signal, as shown at block 113. Next, the method continues with the step of generating a second signal, as shown at block 114. Upon receipt of the second signal, water is prohibited from being provided to the ice-making apparatus and the flow of water to the icing site through the closed loop water circulating unit is initiated, as shown at blocks 115 and 116, respectively.

The controller 48 generates the first signal for receipt by the valve 11 to supply the ice-making apparatus with water from the water supply. The controller 48 also generates the second signal for receipt by the valve 11 and the pump 18 to stop the flow of water from the water supply and to start the flow of water to the manifold 22 and across the ice mold 24.

The method continues with the step of cooling the water as it flows through the circulating unit, as shown at block 117. That is, cold refrigerant is routed to the ice mold 24 so that the water is cooled as it flows across the ice mold 24. Also, as the cooled water collects in the reservoir 14 and continues to circulate, the temperature of the water in the reservoir 14 continues to drop. Therefore, the temperature of the water diminishes as it circulates through the system 10.

The method proceeds with the step of sensing the temperature of the water, as shown at block 118. Preferably, the temperature sensor 46 is located in the reservoir 14. Next, the sensed temperature is compared to a first predetermined temperature threshold, e.g., 27° F., as shown at conditional block 120. If the temperature of the water exceeds the first temperature threshold, and the seeding process has not been initiated yet, the system 10 continues sensing the temperature of the water, as shown at conditional block 120. However, if the temperature of the water falls below the first temperature threshold, a third signal is generated, as shown at block 122.

The flow of water through the closed-loop water circulating unit is stopped upon receipt of the third signal, as shown at block 124. The pump 18 receives the third signal from the controller 48 and shuts off. The water flow is stopped before an unstable level of supercooling is reached. Also, ice seeding is allowed to occur on the ice mold 24. Next, the method continues with the step of generating a fourth signal after a first predetermined amount of time after generating the third signal, as shown at block 126. After sufficient time has passed to allow seeding to occur, the fourth signal is generated. Upon receipt of the fourth signal, the pump 18 restarts the flow of water to the ice mold 24, as shown at block 128.

If it is desirable to verify seeding before making ice, the method includes the step of detecting a successful seeding. An amount of time elapsed since the generation of the fourth signal is determined, as shown at conditional block 130. The elapsed time is then compared to a second time threshold, preferably 10 seconds in the example, as shown at conditional block 132. If the elapsed time does not exceed the second time threshold, the method continues to determine the elapsed time until the second time threshold has been exceeded.

If the elapsed time has exceeded the second time threshold, the sensed temperature is compared to a second predetermined temperature threshold, preferably 32° F. in the example, as shown at conditional block 134. If the sensed temperature is less than the second temperature threshold, the method returns to generate the third signal, as shown at block 122, and the method continues to attempt to seed the ice mold 24.

If the sensed temperature equals or exceeds the second temperature threshold, the method continues with the step of determining whether the elapsed time exceeds a third predetermined amount of time, as shown at conditional block 136. If the elapsed time has not exceeded the third predetermined time threshold, the method continues to monitor the elapsed time until it exceeds the third predetermined time threshold or other sensed signal indicating that ice formation is complete. As shown in FIG. 3*b*, a level of water in this reservoir may be sensed to indicate that ice formation is complete. Once the elapsed time has exceeded the third predetermined time threshold, ice formation is complete, as shown at block 138 and the ice is released, as shown at block 140. The method proceeds to repeat the entire process.

Figure 4:
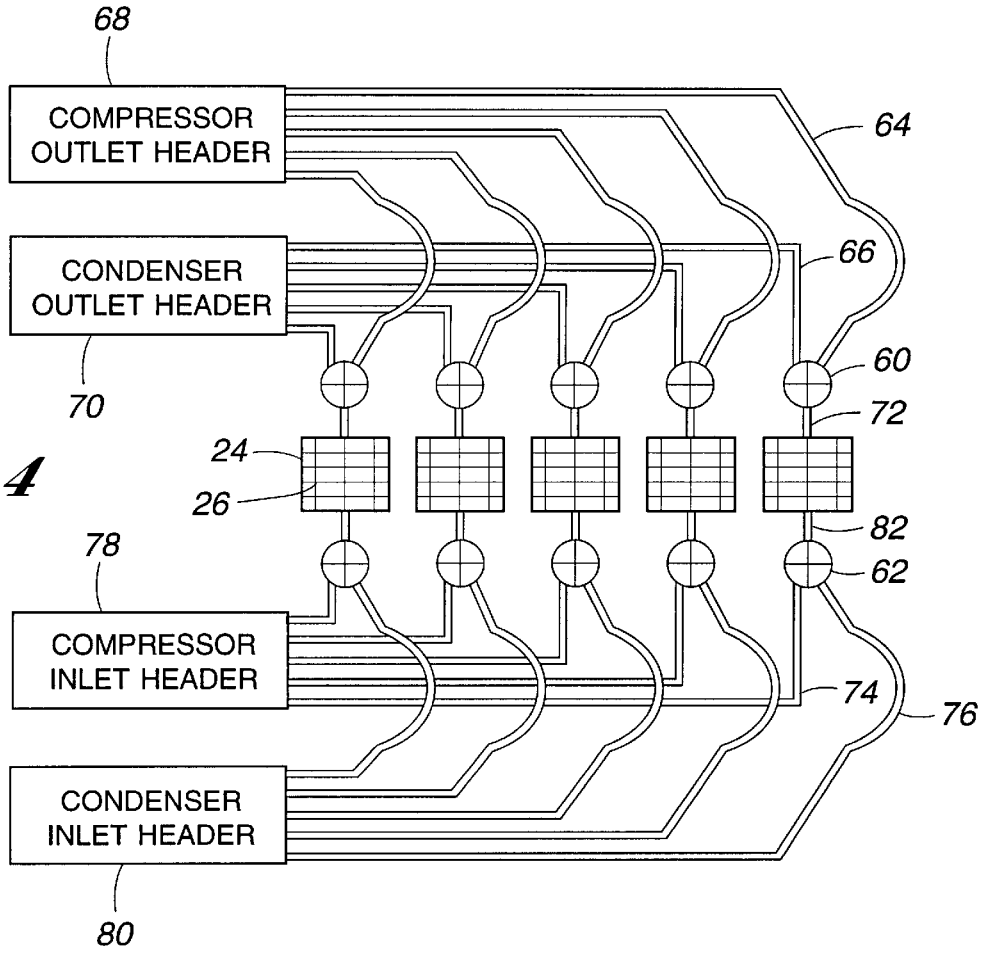
FIG. 4 is a schematic diagram of a second embodiment of the system of the present invention.

Turning now to FIG. 4, there is shown the system 10 of the present invention having a plurality of ice molds 24 each containing cavities 26 in which to form the ice cubes. Each ice mold 24 is equipped with a refrigeration inlet valve 60 and a refrigeration outlet valve 62. The plumbing associated with the water system is not shown, but is comparable to that of FIG. 2. However, there are geometry changes required to accommodate the presence of the extra valves 60, 62 and the extra refrigerant plumbing lines. Preferably, preferably, the plurality of ice molds 24 would have a common reservoir 14 and a common pump 18 but separate manifolds 22.

Each inlet valve 60 has an inlet refrigerant line 64, 66 from a corresponding compressor outlet header 68 and a corresponding condenser (or expansion device) outlet header 70, respectively. Each inlet valve 60 is able to pass refrigerant to its associated ice mold 24 via a first refrigerant line 72.

Each outlet valve 62 has an outlet refrigerant line 74, 76 going to a corresponding compressor inlet header 78 and a corresponding condenser inlet header 80, respectively. Each outlet valve 62 is able to receive refrigerant from its associated ice mold 24 via a second refrigerant line 82. Preferably, each of the refrigerant lines 64, 66, 72, 74, 76 and 82 are insulated to improve the efficiency of the system 10.

The features of the system 10 of the invention as shown in FIG. 4 is illustrated utilizing five ice molds 24. However, it should be appreciated that the present invention applies to any number of ice molds 24. Assuming an initial ice cube formation time of eight minutes, which upon interactive self-adaptation may be subsequently changed, the five ice molds 24 are operated at two minute intervals in a successive manner. First, the reservoir 14 is filled with water and cold refrigerant is routed to each of the five ice molds 24. The water then flows across each of the five ice molds 24 until the desired temperature of the reservoir 14 is sensed by the sensor 46. Once the desired temperature is reached, the flow of water is prohibited across each of the molds 24. With the cessation of water flow, each of the five molds 24 begin ice seeding.

Water flow is then resumed across the first ice mold 24 and ice formation begins. If necessary, the seeding process is repeated on the first ice mold 24 until seeding occurs. After two minutes, water flow and, if necessary, seeding is initiated on the second ice mold 24. After another two minutes, water flow and any necessary seeding is initiated on the third ice mold 24. Two minutes later the same step is performed for the fourth ice mold 24. Another two minutes later the same process is initiated on the fifth ice mold 24.

Now that a preset time, preferably eight minutes when in the preferred embodiment, has elapsed, ice formation is complete on the first ice mold 24. At the same time that water flow is initiated on the fifth ice mold 24, the valves 60, 62 associated with the first ice mold 24 will switch. Instead of routing cold refrigerant from the compressor outlet header 68 to the compressor inlet header 78, hot refrigerant is routed from the condenser outlet header 70 to the condenser inlet header 80. The hot refrigerant warms the first ice mold 24 until the ice cubes are released from the ice mold cavities 26. At this time, the first ice mold 24 effectively acts as a condenser and lowers the temperature of the high pressure refrigerant that is passed to the condenser inlet header 80 of a true condenser (not shown), thus increasing the cooling capacity of the system 10.

After sufficient time has passed to release the ice cubes, preferably less than one minute, the valves 60, 62 associated with the first ice mold 24 switch back to the cold refrigerant compressor outlet header 68 and the compressor inlet header 78. Additional water may be added to the reservoir 14 at this time to make up for any water lost to the formation of ice.

After two minutes has passed from the initiation of water flow and/or seeding at the fifth ice mold 24, the first ice mold 24 is seeded and water flow across the first ice mold 24 is re-initiated. Simultaneously, hot refrigerant is routed to the second ice mold 24 to permit the release of the ice cubes on the second ice mold 24 since eight minutes has elapsed from the initiation of ice formation in the second ice mold 24. Subsequently at two minute intervals, each ice mold 24 is temporarily switched into condenser mode, the reservoir 14 is refilled and the next ice mold 24 is seeded and subjected to flowing water.

This process allows the heat used to release the ice cubes to be extracted from the refrigerant that is being used to form additional ice cubes. The efficiency of the system is increased and the cooling capacity is increased resulting in a shorter cycle for forming ice. If each of the ice molds were operated simultaneously, the increased cooling capacity achieved during the release of the ice cubes would be wasted since water would not be flowing across any of the ice molds 24. The ice cube formation time would then be greater than that of a similar-sized cooling system used in a staggered operation.

To improve ice clarity, additional controlled conditions of vacuum pressure or heating, preferably both, can be employed in the formation process as shown at 33 (FIG. 2). For example, if the water can be heated before it is used for making ice so that the solubility of air in the water is reduced. Reduced solubility can result in reduction of dissolved air if opportunity is given for the excess dissolved gases to escape. If the water is frozen before it reabsorbs air or gas, the formation of small air bubbles in the resulting ice can be reduced, thereby improving the clarity of the ice. However, preheating water requires added energy which decreases the overall energy efficiency of the ice-making system. However, this problem can be circumvented by using the system shown in FIG. 5.

Figure 5:
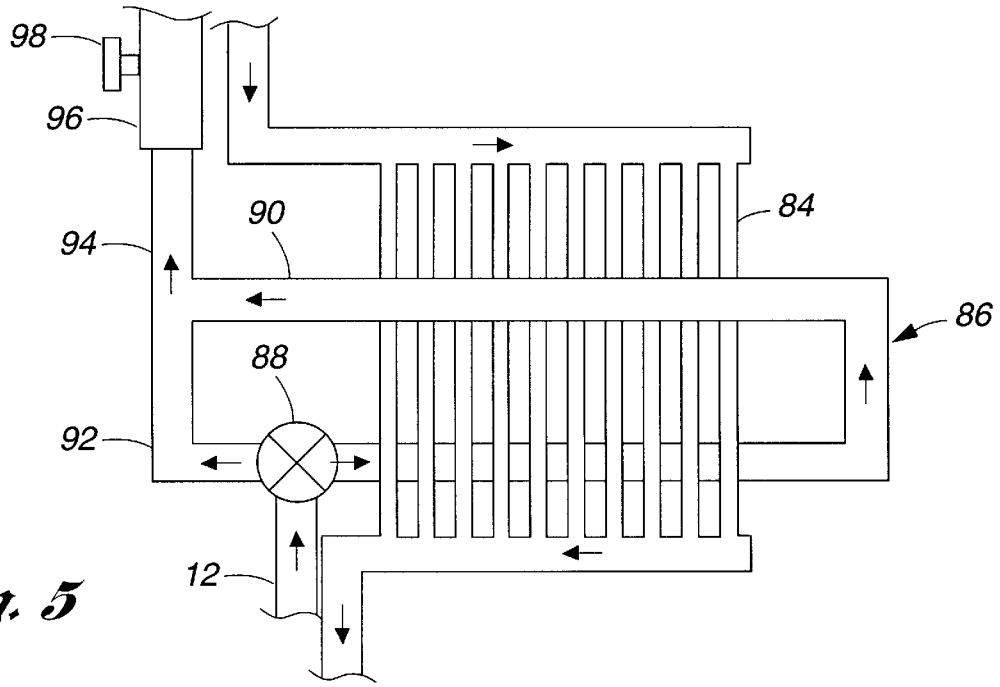
FIG. 5 is a schematic diagram of the preheating feature of the preferred embodiment of the system of the present invention.

As shown in FIG. 5, a condenser 84 is wrapped with a water line 86 fluidly coupled to the water inlet line 12. A routing valve 88 is disposed in the water line 86. The routing valve 88 routes all or a portion of the water received from the water inlet line 12 around the condenser 84. The water passing around the condenser 84 is heated by the heat rejected from the condenser 84. As the water is heated, the heat rejection capability of the condenser 84 is correspondingly increased. As a result, the cooling capacity of the cooling system is increased without increasing the energy consumption of the cooling system.

The heated water portion 90 is then mixed with an unheated water portion 92, if any, that bypassed the condenser 84. The combined water 94 is then passed to the ice-making system 10. Referring to FIG. 3, the of preheating the flow of water is performed just before step 113.

The water inlet line 12 is connected to an insulated water line 96 having a relief valve 98 or an insulated sump in which air or gas that is released from the heated water can be purged. An option for improved degassing involves use of a vacuum pump and a vacuum chamber with appropriate liquid level controls and a pump such that the water is given significant surface area exposure to the vacuum via spraying, agitation, and flow for effective removal of excessive gases in solution with the water. Preferably, the warm outgassed water is then passed through a heat exchanger (not shown) where it is cooled to room temperature without exposing the warm water to air and without expending cooling capacity. The resulting luke-warm water is then passed to the ice-making system 10 where it produces ice with fewer bubbles than if it had not been heated or subjected to a vacuum. If the heated water is passed directly to the ice-making system 10 and outgassing is performed in the reservoir 14, the plumbing is simplified but the cooling capacity is reduced since heat from the condenser will be returned to the system 10.

Figure 1:
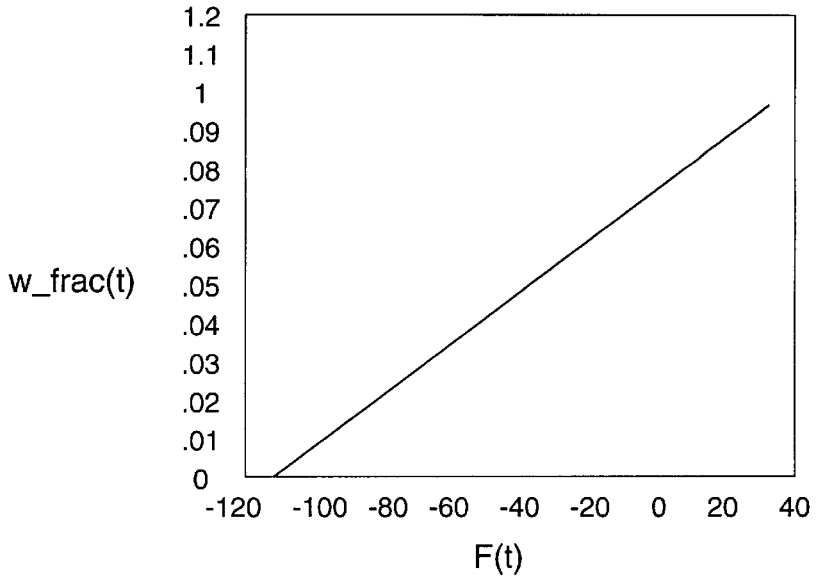
FIG. 1 is a graph illustrating the fraction of liquid water in a slush mixture after equilibration of ice with water as a function of the initial temperature of supercooled water.
Figure 6:
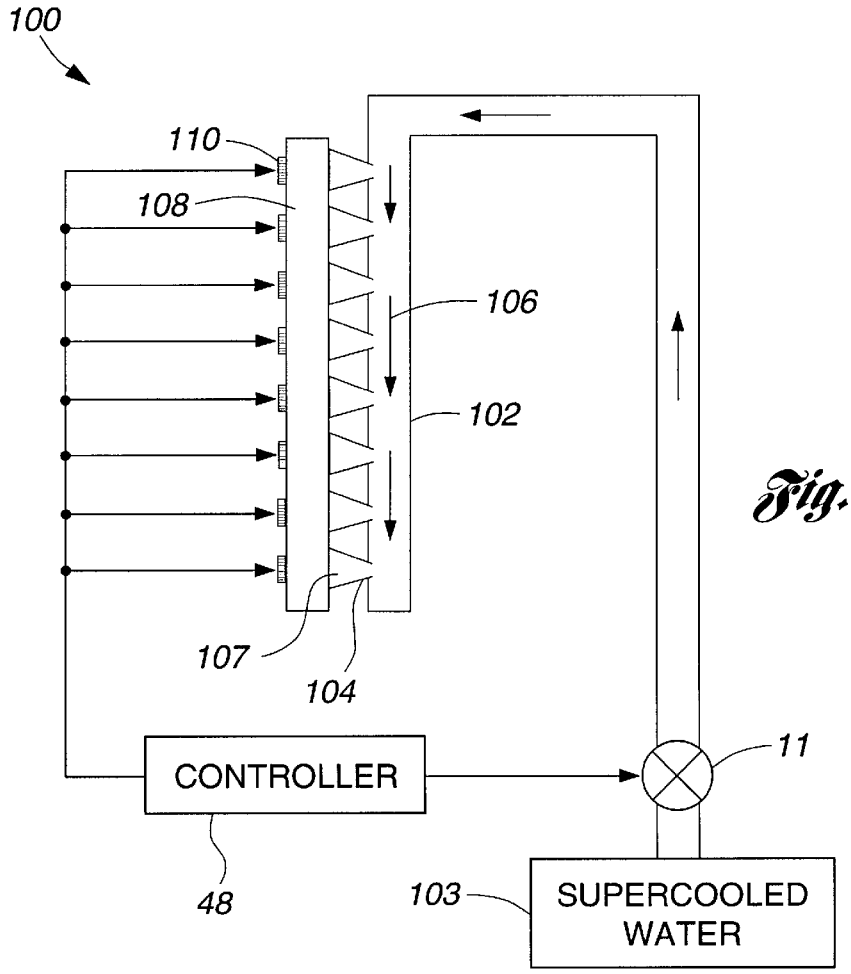
FIG. 6 is a schematic diagram of a third embodiment of the system of the present invention.
Figure 7:
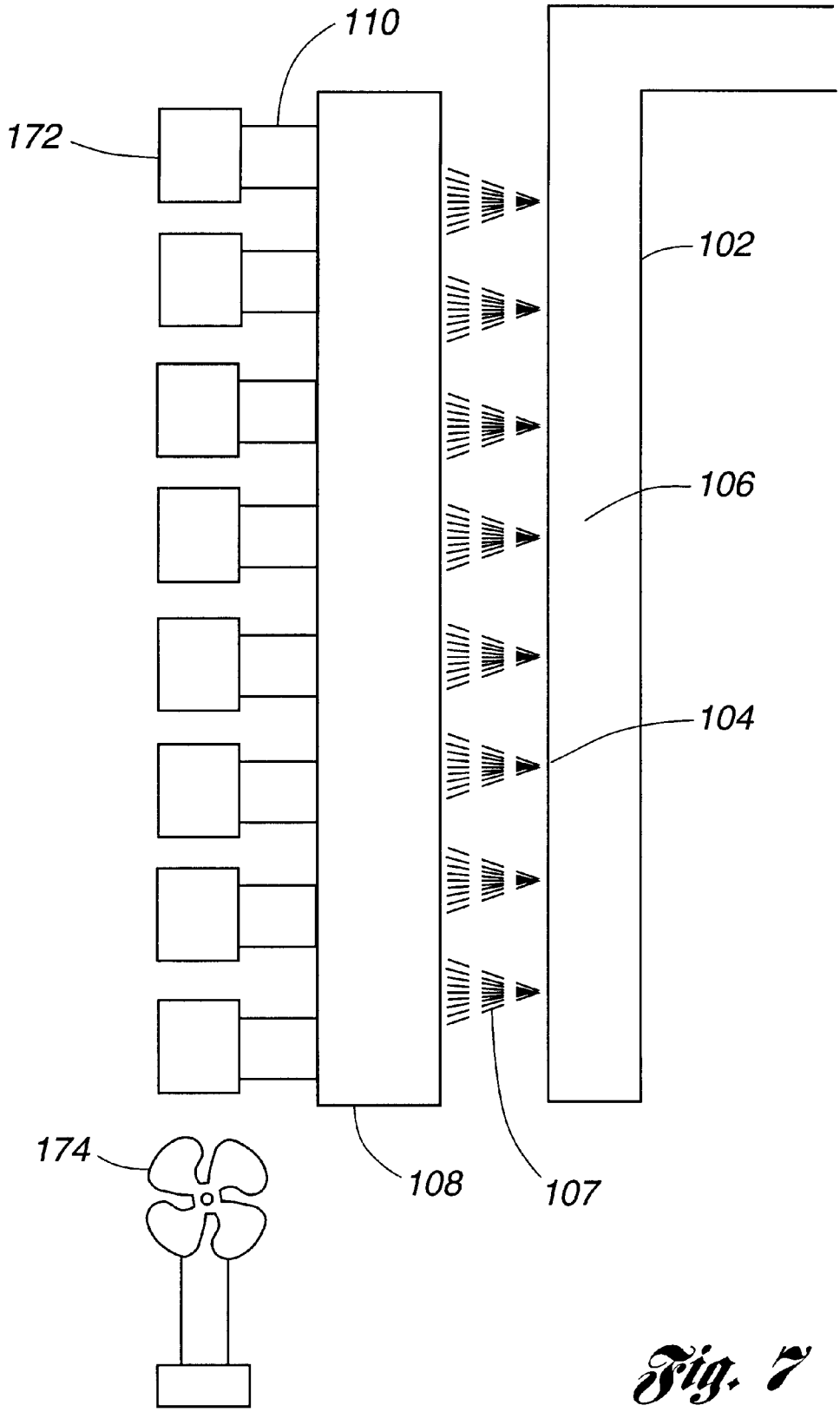
FIG. 7 is a schematic diagram of another embodiment of a system portion similar to FIG. 6.

Turning now to FIG. 6, there is shown a portion of a simplified ice-making system 100. The system 100 includes a water manifold 102 having one or more spray nozzles or atomizers 104. Pressurized supercooled water 106 is delivered to the water manifold 102 from a supply 103 of supercooled water. The advantage of the supercooled water 106 is that the speed of ice formation is increased. The spray nozzles 104 produce a spray 107 of small supercooled water droplets that is directed onto a chilled ice-making mold 108. The chilled ice mold 108 can be cooled conventionally with evaporating refrigerant (not shown) or with Peltier thermoelectric devices 110, which may optionally be attached to heat sinks as shown at 172 in FIG. 7 and cooled by forced convection from a fan 174.

When the spray 107 strikes the chilled ice mold 108 the water droplets freeze upon contact. When the ice cubes are completely formed, the controller 48 reverses the polarity of the current driving the Peltier effect devices 110 thereby converting the Peltier devices 110 to heaters. Consequently, the ice mold 108 will heat and release the ice cubes. In the case of refrigerant based cooling system, the refrigerant plumbing is switched via valves to temporarily convert the ice mold 108 into a condenser for a sufficient time to release the ice cubes.

In a further refinement, it is possible to increase the degree of supercooling in the spray by subjecting the cooled water to high pressure which lowers the freezing temperature. The pressure necessary to depress the freezing temperature of water by 10° F. is approximately 1028 psi. The cost and complexities of operating with the thousands of pounds per square inch necessary for very significant degrees of supercool liquefaction typically preclude achieving significant freezing point depressions by this method except for special applications.

Alternatively, the water spray can be reduced to a sufficiently fine mist and the ice mold can be cooled at a sufficient rate and to a low enough temperature to prevent both the melting of ice on the molds and the formation of make-up water without having to supercool the spray water supply. This prevents the formation of ice at the spray nozzles or at other undesired locations in the system. For certain combinations of mist density and ice mold cooling rates, it is possible to avoid the formation of excess ice and excess make-up water from melting without having to cool the water before it is transformed to mist. This simplifies the cooling system by not having to provide means for separately cooling the water and the ice molds. The improvements in the sensing system include: Application of an opaque and non-reflecting shield 51 to block ambient infrared light introduced through the door 52 of the storage bin 49 with cubes 50 to block ambient infrared light from the sensor(s), use of a narrow angle directed IR beam from the emitter, use of a narrow angle receiver IR beam receiver, design of an opaque plastic housing for the IR emitter and receiver, and application of opaque and transparent materials to reduce undesired ambient IR signals from reaching the IR receiver.

A number of problems inherent to optoelectronic emitter/detector (sometimes referred to as emitter/receiver) interrupter sensing pairs located on opposite sides of the detection site have been recognized and overcome with the present invention. As ice is formed, the water continuously flowing off the ice molds tends to accumulate minerals, leaving behind ice of higher purity than the supply water. Problems result from water splashing onto the optics and leaving behind a hazy mineral residue which tends to diminish both the emitted signal and also the detected signal of IR or other chosen electromagnetic wavelength is chosen for ice detection. Ambient light coming through translucent ice machine panels and coming in through the ice bin door 52, when open, also tends to cause errant operation.

The ice sensing problems have been overcome by implementation of several design, electronics, and software methods. The splashing problem fouling the optics is overcome by placing the emitters and detectors within recesses formed by the tubes of plastic which is opaque to IR radiation. This way the direct splashes of ice onto the optics are greatly reduced and undesired light is primarily blocked from the detector from other than the desired source, the emitter. The receiver is mounted to as to be aligned away from, and therefore be less sensitive to, the ambient light when the ice bin door is open. An auxiliary non-reflective and opaque shield 51 is mounted so as to shield, deflect, and absorb undesired ambient light from the open ice bin door and also from translucent ice machine panels. Non-reflective and opaque surfaces are located on or in the bin to reduce undesired reflected and transmitted sources of IR, or other frequency of electromagnetic radiation, for optically detecting the presence of ice. The recesses for the optics also have drain slots on the lower sides such that capillary action plus the inherent vibration of the machine tend to readily cause draining of any extraneous moisture which manages to splash into the recess of the optics.

Preferably, two emitters and two detectors are arrayed with separation, preferably one at each end, although two or more emitters and detectors may be employed at each end depending on the size of the chute and the size of the ice made, to cover the width of the ice channel such that a single piece of ice dropping through the ice chute will block either one beam or the other. The two can be wired in series such that the signal received indicates blockage of a logical OR function of the two beams. The detected analog signal can be measured with detection circuitry having a threshold such that the output signal is a logical level signal representative of ice present. Alternatively, the detected analog signal can be measured with along and detection signal which looks for a change in signal representative of that caused by optical blockage caused by ice. An improvement in this concept is implemented by pulsing the emitters on and off such that the analog signals seen at the detectors during the off portion of the emitters is representative of the ambient and undesired light levels for which the emitters are sensitive. The signals representing ambient light level are electronically subtracted form the signal measured during the on portion of the emitters, resulting in a difference signal more accurately representative of a sense of ice blocking the beam.

The advantage of the present invention are numerous. First, the formation of slush in the system is eliminated. Second, energy management is improved to minimize cooling time and energy consumption. Third, ice clarity is improved by preheating and degassing the water before initiating the formation of ice. Fourth, the use of supercooled water in conjunction with spray nozzles or atomizers increase the uniformity of ice cubes and decrease the cooling time. Finally, the use of Peltier devices eliminate the complexity of a refrigerant-based cooling system. Moreover, after high quality ice is made, control is maintained during storage for example, by controlling humidity of the storage bin, preferably by shielding gas flow through the storage bin.

While the best modes for carrying out the invention have been described in detail, those familiar with the art to which this invention relates will recognize various alternative designs and embodiments for practicing the invention as defined by the following claims.

What is claimed is:

1. For use with an ice-making apparatus having at least one icing site for forming ice and a closed loop water circulating unit for circulating a flow of water to the at least one icing site of the apparatus, a method for electronically controlling the location of the formation of ice, the method comprising:

starting the flow of water through the closed loop water circulating unit to the at least one icing site;

cooling the water at the at least one icing site as it flows through the closed loop water circulating unit;

sensing a temperature of the water as it circulates through the closed loop water circulating unit;

comparing the sensed temperature to a first predetermined temperature threshold;

if the sensed temperature is below the first predetermined temperature threshold, generating a signal;

stopping the flow of water to the at least one icing site upon receipt of the signal, to generate an ice seed at said at least one icing site;

restarting the flow of water to the at least one icing site to form ice at the at least one icing site;

sensing a parameter related to completion of ice making, and initiating a harvest cycle in response to sensing said parameter.

2. The invention as defined in claim 1 wherein said circulating unit includes a reservoir and said sensing comprises detecting a level of fluid in said reservoir.

3. The invention as defined in claim 1 wherein said sensing comprises timing the flow of water to said icing site after said restarting.

4. The invention as defined in claim 2 and comprising insulating the reservoir.

5. The invention as defined in claim 1 wherein said circulating unit includes a reservoir and said sensing includes detecting the temperature of water in said reservoir.

6. The invention as defined in claim 1 and further comprising depositing harvested ice in a storage bin.

* * * * *